US006386263B1

(12) United States Patent
Tomlinson et al.

(10) Patent No.: US 6,386,263 B1
(45) Date of Patent: May 14, 2002

(54) SUSPENDED FLEXIBLE SOUND ABSORBING BANNER

(76) Inventors: Carroll Finley Tomlinson, 5412 Haynes Hall Pl., Charlotte, NC (US) 28270; Eric Von Fange, 1900 Sun Valley La., Fort Mill, SC (US) 29715

( * ) Notice: Subject to any disclaimer, the term of this patent is extended or adjusted under 35 U.S.C. 154(b) by 0 days.

(21) Appl. No.: 09/577,326

(22) Filed: May 24, 2000

Related U.S. Application Data

(60) Provisional application No. 60/192,477, filed on Mar. 27, 2000.

(51) Int. Cl.[7] ..... E06B 3/80

(52) U.S. Cl. ..... 160/328; 40/604

(58) Field of Search ..... 160/327, 328, 160/380, 395; 40/603, 604; 52/144, 145; 181/30, 290, 210, 284, 287

(56) References Cited

U.S. PATENT DOCUMENTS 1,675,102 A * 6/1928 Holland
2,899,764 A * 8/1959 Oberlin, Jr.
4,057,123 A * 11/1977 Erickson
4,890,403 A * 1/1990 Dinan
5,732,494 A * 3/1998 Davey
6,192,611 B1 * 2/2001 Molla

* cited by examiner

*Primary Examiner*—Blair M. Johnson

(74) *Attorney, Agent, or Firm*—H. Jay Spiegel

(57) ABSTRACT

A suspended flexible sound absorbing banner includes a large rectangular flexible sound absorbing material, preferably made of fiberglass or other low density porous sound absorptive material, and covered with a porous, perforated or non-perforated, impermeable membrane such as NYLON sailcloth or commercial plastic membranes capable of providing for sound absorption in a desired frequency range and structural integrity sufficient to support tension required without damage while permitting application of suitable graphics for desired visual effect. Opposed edges of the banner are clamped between pairs of elongated U-shaped cross-section spreader bars. Each opposed edge is clamped by bending the edge of the banner through four 90° turns. A smaller dimensioned U-shaped spreader bar is receivable within a larger dimensioned U-shaped spreader bar and the two spreader bars may be clamped together with the edge of the banner clamped between them. At least two tension tabs consisting of elongated rigid bars are attached at spaced locations along the spreader bars and include pre-formed holes designed to receive an attachment for an elongated cable. The cables are stretched into attachment with adjacent structures of the ceiling of an arena such as, for example, parallel elongated I-beams. When the cables are tensioned, the banner is stretched and the tension tabs pivot in response to this stretching action so that the banner is stretched to a generally planar configuration extending across a space parallel with the floor and ceiling of the arena. The strength of the sound transparent covering permits the tensioning of the system. The banner has been found to attenuate and absorb sound waves to an unexpected degree.

17 Claims, 5 Drawing Sheets

SUSPENDED FLEXIBLE SOUND ABSORBING BANNER

The present invention relates to a suspended flexible sound absorbing banner. Applicants claim the benefit under 35 U.S.C. §119(e) of U.S. Provisional Application Ser. No. 60/192,477 filed Mar. 27, 2000.

BACKGROUND OF THE INVENTION

Acoustical treatments designed to absorb and attenuate sound are well known and are embodied in wall treatments, ceiling treatments and floor treatments. In a stadium or arena, it is often desirable to provide acoustical treatments for sound diffusion and sound absorption. Indoor arenas are noted for their large ceiling structures including elongated structural beams and for their lack of acoustical treatments.

Crowd noise travels from its source in all directions including upwardly. In the typical indoor arena, crowd noise reflects off the ceiling and travels downwardly toward the playing surface. Placement of sound absorbing structures adjacent the ceiling would go a long way toward attenuating crowd noise in a manner that would be pleasing to the ear.

A need has, accordingly, developed for a sound absorbing device that can easily be mounted on or adjacent to the ceiling of an indoor arena to absorb crowd noise in an effective manner. It is with this need in mind that the present invention was developed.

SUMMARY OF THE INVENTION

The present invention relates to a suspended flexible sound absorbing banner. The present invention includes the following interrelated objects, aspects and features:

(1) In the preferred embodiment, the present invention includes a large rectangular flexible sound absorbing material, preferably made of fiberglass, and covered with a surface membrane such as NYLON material comprising a banner. The surface membrane may be porous, perforated or non-perforated and impermeable. It should have an appropriate mass layer and sufficient compliance to provide absorptive efficiency across a desired frequency range while having the structural strength to withstand a desired degree of tensioning.

(2) Opposed edges of the banner are clamped between pairs of elongated U-shaped cross-section spreader bars. Each opposed edge is clamped by bending the edge of the banner through four 90° turns. A smaller dimensioned U-shaped spreader bar is receivable within a larger dimensioned U-shaped spreader bar and the two spreader bars may be clamped together with the edge of the banner clamped therebetween.

(3) At least two tension tabs consisting of elongated rigid bars are attached at spaced locations along the spreader bars. Such tension tabs include pre-formed holes designed to receive an attachment means for an elongated cable.

(4) The cables are stretched into attachment with adjacent structures of the ceiling of an arena such as, for example, parallel elongated I-beams. If desired, turnbuckles may be employed to tension the cables. Alternatively, tension adjustment may be accomplished through use of an adjusting bracket consisting of an elongated flexible piece of metal with a multiplicity of holes spaced along its length. A snap hook attached to a cable may be coupled to one of the spaced holes to create tension. The adjusting bracket is typically attached to an I-beam while the cable and snap hook are attached to the banner. When the cables are tensioned, the banner is stretched and the tension tabs pivot in response to this stretching action so that the banner is stretched to a generally planar configuration extending across a space parallel with the floor and ceiling of the arena. The strength of the sound transparent covering permits the tensioning of the system.

(5) The banner has been found to attenuate and absorb sound waves to an unexpected degree. Through the use of several suspended flexible sound absorbing banners in accordance with the teachings of the present invention, dramatic reduction in reflected noise may be achieved in an indoor arena.

As such, it is a first object of the present invention to provide a suspended flexible sound absorbing banner.

It is a further object of the present invention to provide such a device in which a generally rectangular large fiberglass-sailcloth combination is stretched across an arena parallel to the ceiling and floor thereof.

It is a still further object of the present invention to provide such a device in which two spreader bars are provided on each side of the banner and wherein edges of the banner are clamped therebetween.

It is a still further object of the present invention to provide coupling means adapted to couple elongated cables at spaced locations about the spreader bars to allow the banner to be stretched into desired configuration within an indoor arena.

These and other objects, aspects and features of the present invention will be better understood from the following detailed description of the preferred embodiment when read in conjunction with the appended drawing figures.

SPECIFIC DESCRIPTION OF THE PREFERRED EMBODIMENT

Figure 1:
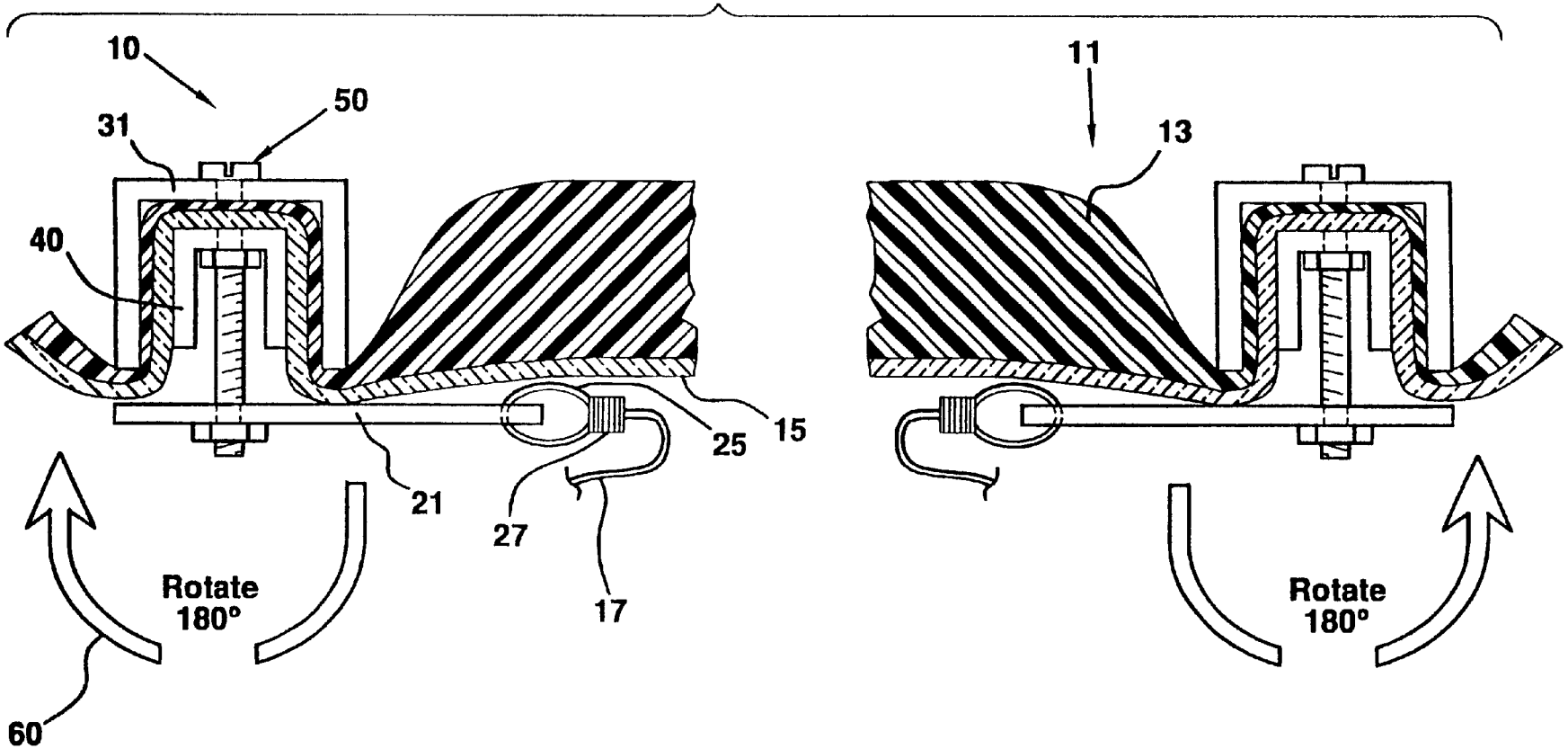
FIG. 1 shows a side view partially in cross-section depicting the orientation of parts when the inventive banner is being assembled.
Figure 2:
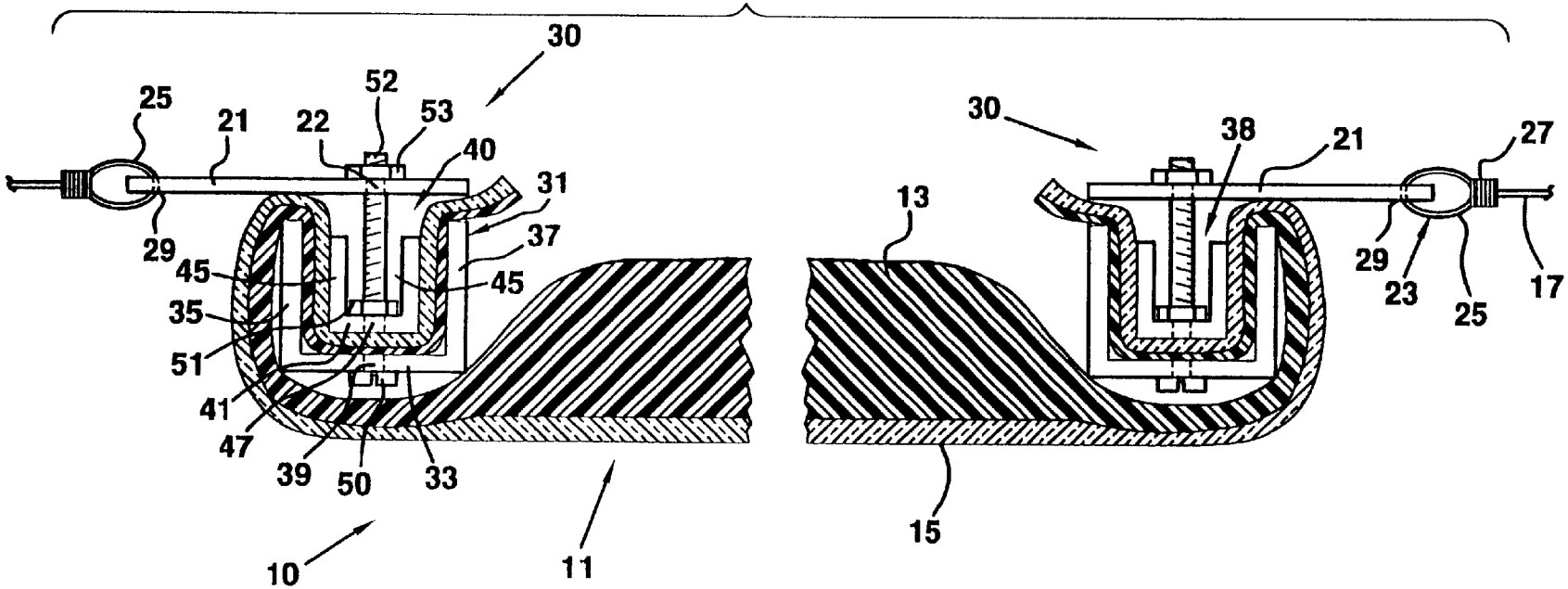
FIG. 2 shows a view of the assembled banner with the cables thereof stretched and with the assembly in its orientation in use.

With reference to FIGS. 1 and 2, the present invention is generally designated by the reference numeral 10 and is seen to include a large banner of sound absorbent material generally designated by the reference numeral 11 and including a fiberglass bed 13, preferably made of a thickness of approximately two inches and with a density of about 0.75 to 2.0 pounds per cubic foot. The fiberglass bed 13 is covered on one side by a surface membrane protective covering 15, preferably made of a material such as, for example, rip stop NYLON sailcloth. The sailcloth covering 15 may be made with any desired aesthetically pleasing design thereon through any desired process such as, for example, screen printing, graphics, etc.

Figure 3:
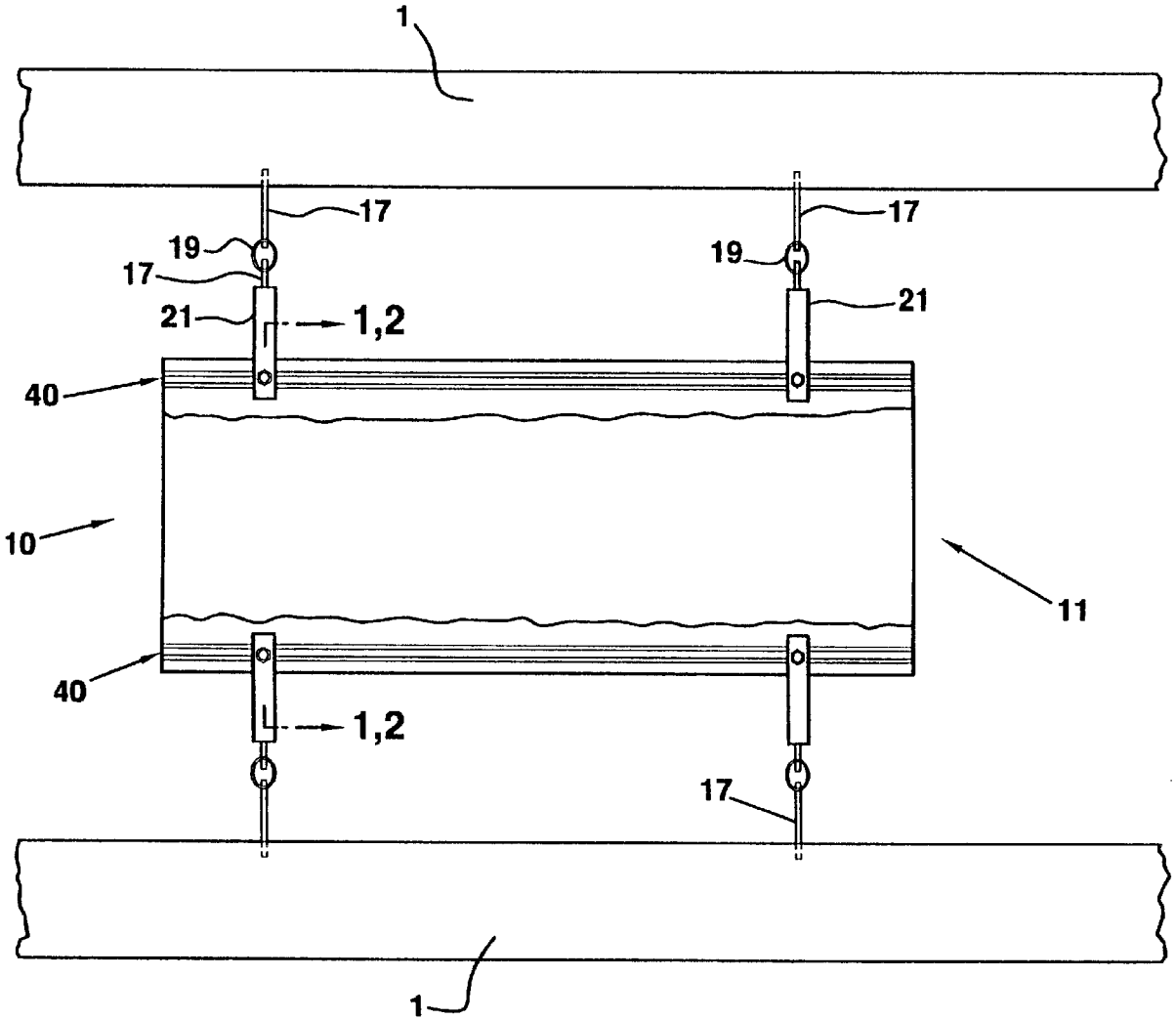
FIG. 3 shows a view looking downwardly on an installed banner.

With reference to FIG. 3, the banner 11 is seen from above in mounted configuration. The indoor arena (not shown in detail) where the banner 11 is mounted typically includes a plurality of I-beams 1 mounted in parallel relation to one another just below the roof. The inventive system may be mounted between two parallel I-beams 1 in the manner shown in FIG. 3. As shown, cables 17 are affixed to the I-beams and include tensioning means, for example, turnbuckles 19 designed to allow tightening and loosening of the tension of the cables 17.

Tension tabs 21 are attached to the ends of the cables 17 remote from the I-beams 1. The tension tabs 21 are affixed to the banner 11 in a manner understood better with reference to FIGS. 1 and 2.

FIG. 2 shows the configuration of the system 10 as shown in FIG. 3 but in partial cross-section and showing the specific details not visible in FIG. 3. With reference to FIG. 2, it is seen that the cables 17 are attached to the tension tabs 21 by a connector 23 in the form of a loop 25 with a crimped portion 27 coupling to the cable 17. The loop 25 extends through a pre-formed opening 29 in the tension tab 21 which opening 29 is shown in phantom in FIG. 2.

With further reference to FIG. 2, it is seen that the banner 11 is clamped between clamping means consisting of two clamping assemblies 30. Each clamping assembly includes an outer spreader bar 31 having a U-shaped cross-section including a base 33 and legs 35 and 37 defining an internal chamber 38. The base 33 includes an opening 39 therethrough for a purpose to be described in detail hereinafter.

With further reference to FIG. 2, within the outside spreader bar, an inside spreader bar 40 is provided which has a similar cross-section to that of the inside spreader bar 31 but has smaller dimensions as shown in FIG. 2 so that it fits within chamber 38. The inside spreader bar 40 includes a base 41 and legs 43 and 45. The base 41 has an opening 47 therethrough aligned with the opening 39 in the base 33 of the outside spreader bar 31 and for a purpose to be described in greater detail hereinafter.

As also seen in FIG. 2, the peripheral edge of the banner 11 is inserted within the inner confines of the outer spreader bar 31 and the inner spreader bar 40 is placed over the peripheral edge of the banner 11 in the orientation shown in FIG. 2. A fastening means comprising threaded fastener 50 is inserted through the hole 39 in the base 33 of the outer spreader bar 31, through a hole formed in the banner 11, and through the hole 47 in the base 41 of the inner spreader bar 40. A threaded nut 51 is threaded over the threaded fastener 50 and is tightened to the position shown in FIG. 2 in which the inner spreader bar 40 clamps the peripheral edge of the banner 11 within the recess formed by the outer spreader bar 31.

Thereafter, the tension tab 21 (which is provided with an opening 22) is assembled over the threaded fastener 50 with the opening 22 receiving the end 52 of the threaded fastener 50 and with a further nut 53 threaded over the end 52 of the threaded fastener 50 with the tension tab 21 engaging portions of the peripheral edge of the banner 11 in the manner shown in FIG. 2. The nut 53 is threaded over the end 52 of the threaded fastener 50 and acts as a further clamp clamping the peripheral edge of the banner 11 against the upwardly facing terminations of the legs 35 and 37 of the outside spreader bar 31.

FIG. 1 shows the orientation of parts when they are being assembled together while FIG. 2 shows the orientation of parts in use. With reference to FIG. 1, when the parts are being assembled, the banner 11 is placed flat on a floor surface and the outside spreader bar 31 is placed over the peripheral edge of the banner 11. The inside spreader bar 40 is then installed within the recess formed by the outer spreader bar 31 with the peripheral edge of the banner 11 captured therebetween. The threaded fastener 50 is inserted through the outside and inside spreader bars and through an opening formed in the peripheral edge of the banner 11 and the nut 51 is tightened to clamp the inside spreader bar 40 within the outside spreader bar 31. The threaded fastener 50 then receives the tension tab 21 which is fastened by the nut 53 and the cable 17 is coupled to the tension tab using the loop 25 and the crimped portion 27.

In the position shown in FIG. 1, when the cables 17 are coupled to the I-beams 1 (see FIG. 3), and tightening of the cables 17 begins, the tension tabs rotate in the direction of the arrow 60 (FIG. 1) which causes rotation of the entire clamping assembly including the outside spreader bar 31 and the inside spreader bar 40. When the cables 17 are fully tightened, the rotation will occur over 180° and comparison of FIGS. 1 and 2 shows the tension tabs facing outwardly in FIG. 2 whereas they were facing in the opposite direction, inwardly, in FIG. 1.

Figure 4:
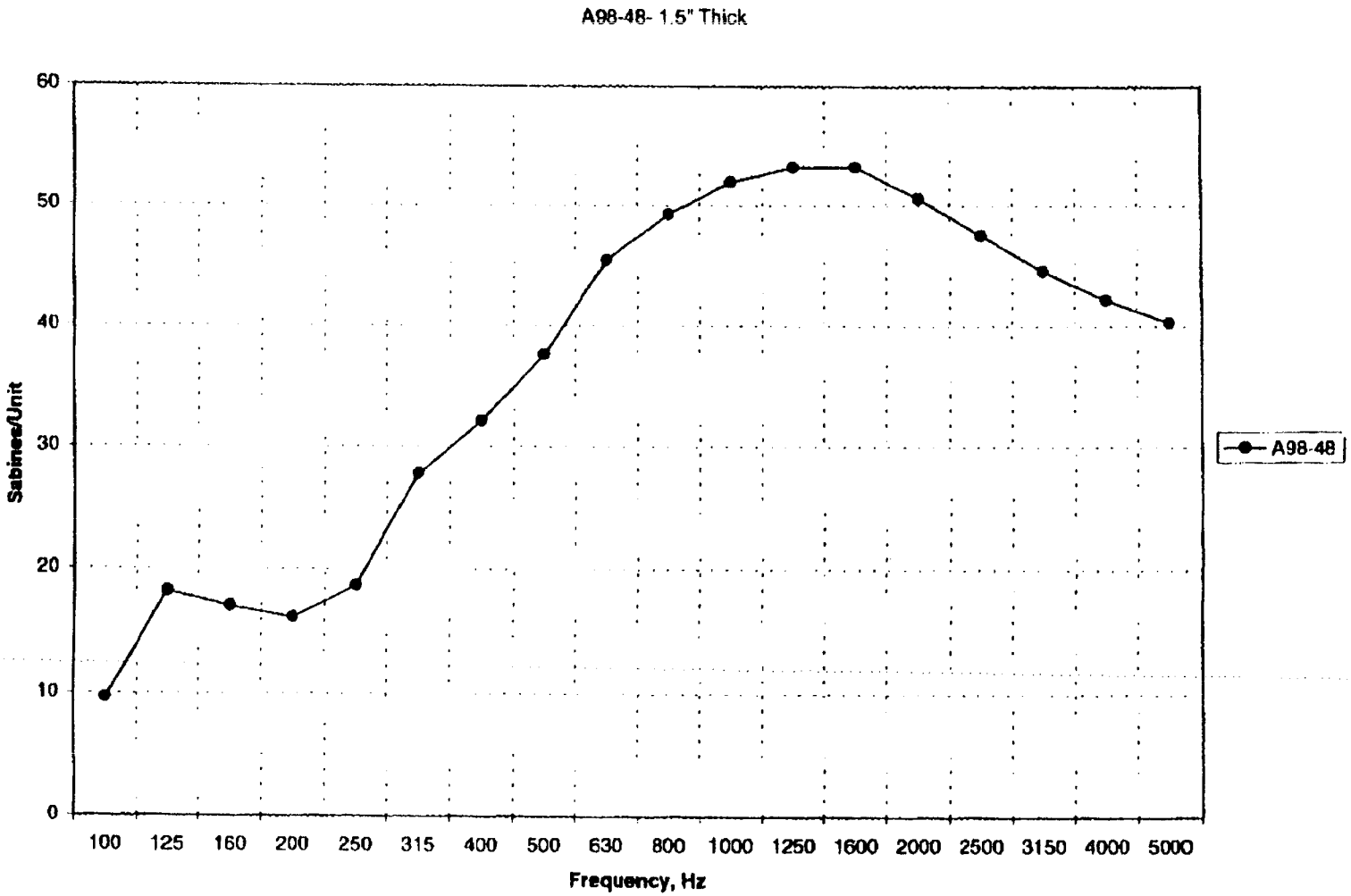
FIG. 4 shows a graph depicting sound (in Sabins per unit vs. frequency) achieved in accordance with the teachings of the present invention.

The inventive system 10 has been found to effectively attenuate and absorb sound waves that emanate upwardly from a crowd attending an event within an indoor arena. FIG. 4 shows a graph depicting the effectiveness of the sound absorption and attenuation that occurs when the present invention is employed in an indoor arena.

EXAMPLE 1

The FIG. 4 graph shows sound absorption in Sabins per unit versus frequency within a frequency range of 100 to 5000 Hz. As should be understood, for the same test to be performed without the inventive banner in place, the graph would show a straight line horizontally extending thereacross at the zero level for each frequency.

The graph of FIG. 4 depicts the results of a test that was conducted by suspending a banner made in accordance with the teachings of the present invention in a horizontal orientation from wires suspended horizontally about 48 inches from the test floor surface. The test method conformed explicitly with the requirements of the ASTM standard test method for sound absorption and sound absorption coefficients by the Reverberation Room Method: ASTM C423-90a and E795-93. The test was conducted at Riverbank Acoustical Laboratories in Geneva, Ill. The microphone employed in the test was a Bruel & Kjaer, Serial No. 1330828.

The banners included in the test each measured 48.5 inches wide by 107.5 inches long by 1.5 inches thick. Each specimen was tested within a test chamber of 10,311 cubic feet. The sound absorption material employed was 1.0 pcf fiberglass faced on one side and edge wrapped with 70 Denier Rip-Stop NYLON with a Urethane coating and ultraviolet inhibitor with brass grommets being employed to enable suspension of the assembly. The unwrapped face was oriented toward the test room floor and the weight of the entire specimen was 11 pounds. At the time of the test, the room temperature was 71 degrees F. and the relative humidity was 58%. Again, the banners were suspended horizontally 48 inches above the floor.

Table 1 shows the test results at frequencies from 100 Hz to 5000 Hz showing absorption per unit in Sabins.

TABLE 1

| ⅓ Octave Center Center Frequency (Hz) | Absorption Per Unit in Sabins | % of Uncertainty With 95% Confidence Limit with Specimen |
|---|---|---|
| 100 | 9.62 | 3.81 |
| ** 125 | 18.21 | 2.03 |
| 160 | 17.05 | 2.21 |
| 200 | 16.17 | 1.91 |
| ** 250 | 18.69 | 1.67 |
| 315 | 27.74 | 1.19 |
| 400 | 32.11 | 1.44 |
| ** 500 | 37.60 | 1.28 |
| 630 | 45.49 | 0.96 |
| 800 | 49.28 | 0.96 |
| ** 1000 | 51.91 | 0.77 |
| 1250 | 53.17 | 0.79 |
| 1600 | 53.20 | 0.70 |
| ** 2000 | 50.58 | 0.64 |
| 2500 | 47.56 | 0.59 |
| 3150 | 44.58 | 0.56 |
| ** 4000 | 42.21 | 0.45 |
| 5000 | 40.31 | 0.54 |

These results revealed more effective sound absorption capability in the inventive banner than was expected, particularly throughout the frequency range tested.

While the banner 11 is preferably rectangular in configuration, it may be provided in any desired shape or configuration depending upon the particular structural characteristics of the mounts that will be employed to install it, a for example, I-beams, brackets, etc. For example, one may make the banner 11 trapezoidal, square, hexagonal or of a rhomboid shape. These are but mere examples of the particular shapes that may be employed for the banner 11.

While fiberglass has been described as the preferred sound absorbing material 13, any suitable sound absorbing material may be employed. Similarly, the surface membrane 15 may be replaced with any aesthetically pleasing acoustically acceptable material capable of providing an appropriate mass layer, a membrane capable of supporting the required tension, and a surface capable of accepting screen printing and graphics to provide a desired visual effect.

Figure 5:
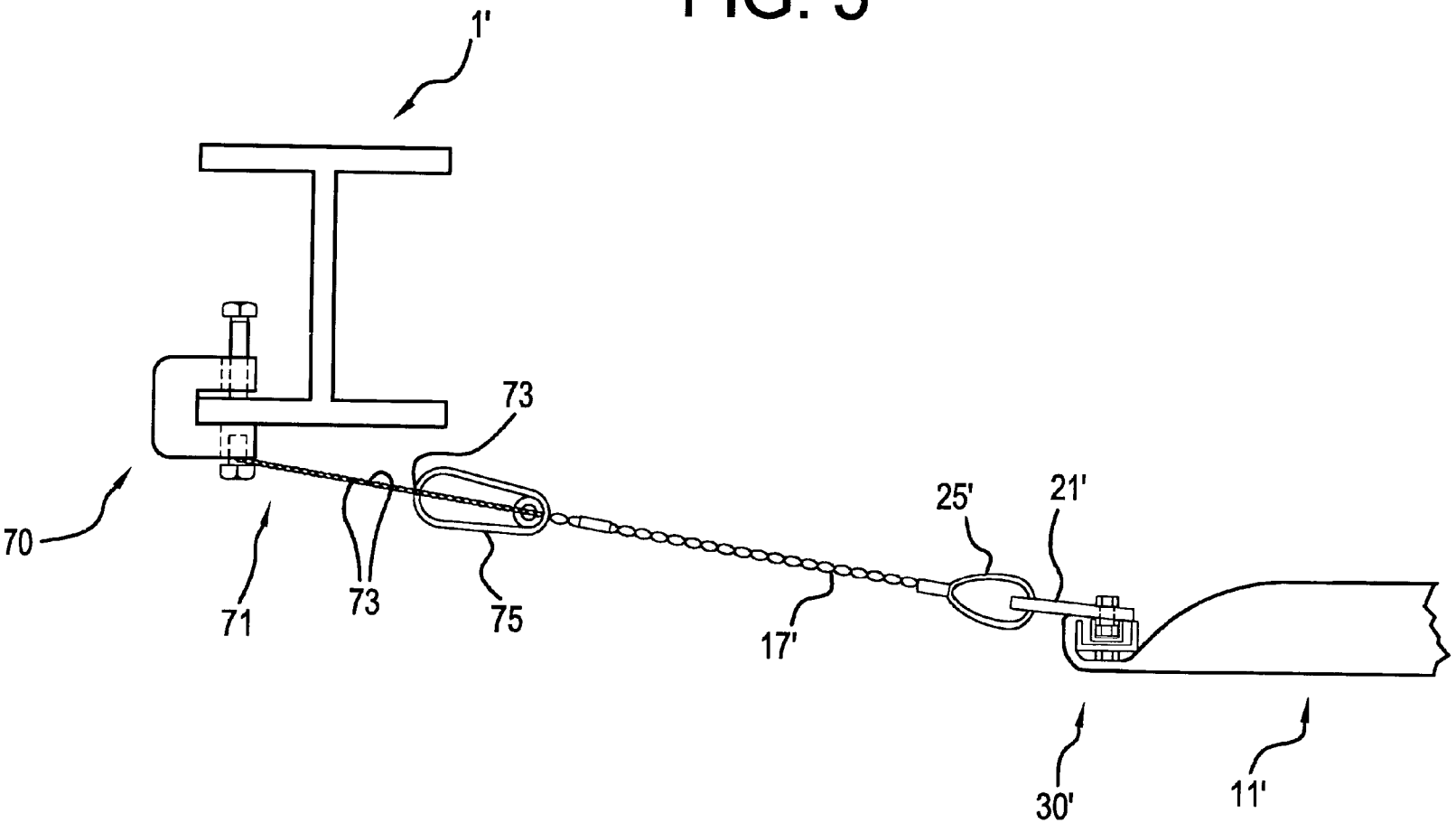
FIG. 5 shows an alternative means for tensioning the banner.

With reference, now, to FIG. 5, an alternative structure to tension the barrier is shown, with like elements from the embodiment illustrated in FIGS. 1–3 being depicted using like primed reference numerals. As seen, the cable 17' may have attached, at its end remote from the tension tab 21', a snap hook 75. The I-beam 1' has a clamp 70 clamped thereto to which is affixed an adjusting bracket 71 consisting of an elongated flexible piece of metal with a multiplicity of holes 73 spaced along its length. The snap hook 75 may be opened in a manner well known to those skilled in the art and may be closed about any one of the holes 73 to appropriately tension the cable 17' and stretch the banner 11'.

As such, an invention has been disclosed in terms of a preferred embodiment thereof that fulfills each and every one of the objects of the invention as set forth hereinabove and provides a new and useful suspended flexible sound absorbing banner of great novelty and utility.

Of course, various changes, modifications and alterations in the teachings of the present invention may be contemplated by those skilled in the art without departing from the intended spirit and scope thereof.

As such, it is intended that the present invention only be limited by the terms of the appended claims.

What is claimed is:

1. A flexible acoustical banner system, comprising:

a) a flexible banner having spaced side edges;

b) clamping means for clamping about each of said side edges, said clamping means comprising an elongated clamp clamped about each side edge, each clamp having an axis of elongation;

c) a plurality of flexible tethers attached to each of said clamping means by attaching means for hiding said clamping means while permitting tensioning of said banner, said attaching means comprising a plurality of tension tabs, one for each tether, each tension tab, in an untensioned position of said banner, being affixed on one of said clamps and rigidly extending laterally of a clamp to which it is affixed, toward another of said clamps and extending each tension tab having attached thereto one end of a tether;

d) each of said a respective one said tethers, said clamping means being exposed when viewed from one side of said banner when untensioned having another end attached to a support; and e) tensioning means for tensioning said tethers to stretch said banner between spaced supports, when said banner is tensioned whereby when said banner is tensioned between spaced supports, said side edges are wrapped over said clamps so that said clamps are hidden from view when viewed from said one side of said banner.

2. The system of claim 1, wherein said banner includes a first layer comprising a sound absorbent material and a second outer layer comprising a membrane having a surface configuration chosen from the group consisting of (1) porous, (2) perforated, and (3) non-perforated impermeable.

3. The system of claim 2, wherein said first layer comprises fiberglass.

4. The system of claim 3, wherein said fiberglass layer has a density in a range of 0.75 to 2.0 lbs./$f^3$.

5. The system of claim 2, wherein said second layer is made of a material chosen from the group consisting of NYLON material or a sound absorptive membrane having a surface chosen from the group consisting of perforated or non-perforated.

6. The system of claim 1, wherein said banner is made of sound absorbent material.

7. The system of claim 1, wherein each of said clamps comprises:

a) a first elongated spreader bar having a U-shaped cross-section and defining an internal chamber;

b) a second elongated spreader bar having a U-shaped cross-section and sized to be received within said chamber;

c) fastening means for connecting said spreader bars together;

d) a said side edge of said banner being clamped between said spreader bars.

8. The system of claim 7, wherein each tension tab is connected to said spreader bars.

9. The system of claim 8, wherein said fastening means comprises a threaded fastener extending through aligned holes in said spreader bars, said fastener having an enlarged head and a threaded shaft, and a threaded nut received on said shaft.

10. The system of claim 9, wherein each said tension tab has a hole sized to receive a said threaded shaft and a further threaded nut clamps said tension tab on said fastener.

11. The system of claim 1, wherein each said support comprises a beam of an associated building.

12. The system of claim 1, wherein said tensioning means comprises a turnbuckle.

13. The system of claim 1, wherein said banner includes a first layer comprising a sound absorbent material and a second layer comprising an acoustical membrane having a surface configuration chosen from the group consisting of (1) porous, (2) perforated, and (3) non-perforated impermeable, said membrane having a mass layer and compliance appropriate to provide desired absorption efficiency across a desired frequency range and of sufficient strength to withstand tensioning without being torn or otherwise damaged.

14. The system of claim 1, wherein said banner is made of sound absorbent material.

15. A flexible acoustical banner system, comprising:

a) a flexible banner having spaced side edges, said banner including a first layer comprising a sound absorbent fiberglass material and a second layer comprising a sound transparent NYLON material;

b) clamping means for clamping about each of said side edges, said clamping means comprising:

i) a first elongated spreader bar having a U-shaped cross-section and defining an internal chamber;

ii) a second elongated spreader bar having a U-shaped cross-section and sized to be received within said chamber;

iii) fastening means for connecting said spreader bars together;

iv) a said side edge of said banner being clamped between said spreader bars;

c) a plurality of flexible tethers attached to each of said clamping means;

d) each of said tethers attached to a support;

e) tensioning means for tensioning said tethers to stretch said banner between spaced supports, each tensioning means comprising a turnbuckle; and f) wherein each flexible tether is connected to a said clamping means by a tension tab connected to said spreader bars, said fastening means comprising a threaded fastener extending through aligned holes in said spreader bars, said fastener having an enlarged head and a threaded shaft, and a threaded nut received on said shaft.

16. The system of claim 15, wherein said fiberglass layer has a density of about 0.75 to 2.0 lbs./$f^3$.

17. The system of claim 15, wherein each said tension tab has a hole sized to receive a said threaded shaft and a further threaded nut clamps said tension tab on said fastener.

* * * * *